US008360486B2

(12) United States Patent
Gschweng et al.

(10) Patent No.: US 8,360,486 B2
(45) Date of Patent: Jan. 29, 2013

(54) VEHICLE SIDE DOOR ASSEMBLY

(75) Inventors: Jörg Gschweng, Mainz (DE); Andreas Heberer, Mainz (DE); Peter Eduard Schuessler, Hösbach (DE); Thorsten Luedtke, Mainz (DE); Winfried Langendorf, Wiesbaden (DE); Scott Charnesky, Birmingham, MI (US); Eric Smith, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 957 days.

(21) Appl. No.: 12/265,674

(22) Filed: Nov. 5, 2008

(65) Prior Publication Data

US 2010/0109350 A1 May 6, 2010

(51) Int. Cl.
*E05B 3/00* (2006.01)
*E05C 3/06* (2006.01)

(52) U.S. Cl. ..... 292/336.3; 292/DIG. 65

(58) Field of Classification Search ..... 292/196, 292/217, 336.3, DIG. 65
See application file for complete search history.

(56) References Cited

U.S. PATENT DOCUMENTS

| | | | | |
|---|---|---|---|---|
| 4,433,506 | A * | 2/1984 | Manning | 49/141 |
| 4,796,934 | A * | 1/1989 | Kesel et al. | 292/336.3 |
| 5,431,462 | A | 7/1995 | Lignell | |
| 5,584,516 | A * | 12/1996 | Cetnar | 292/336.3 |
| 6,042,159 | A * | 3/2000 | Spitzley et al. | 292/216 |
| 6,415,636 | B1 * | 7/2002 | Fukumoto et al. | 70/208 |
| 6,880,867 | B2 * | 4/2005 | Schoen et al. | 292/216 |
| 2004/0251693 | A1 | 12/2004 | Schoen et al. | |
| 2005/0127682 | A1 * | 6/2005 | Cetnar et al. | 292/1 |
| 2007/0029835 | A1 | 2/2007 | Herline et al. | |
| 2007/0069525 | A1 | 3/2007 | Ghannam | |
| 2010/0019512 | A1 | 1/2010 | Gschweng et al. | |
| 2011/0062747 | A1 * | 3/2011 | Teramoto et al. | 296/146.1 |

FOREIGN PATENT DOCUMENTS

| | | | |
|---|---|---|---|
| DE | 7014950 | U | 4/1970 |
| DE | 4413027 | A1 | 10/1994 |
| DE | 69504908 | T2 | 2/1999 |
| DE | 19747710 | A1 | 5/1999 |
| DE | 102004061141 | A1 | 7/2006 |
| DE | 202006015143 | U1 | 12/2006 |
| DE | 102008039509 | A1 | 3/2010 |
| GB | 1442394 | | 7/1976 |
| GB | 2361675 | A * | 10/2001 |

OTHER PUBLICATIONS

German Patent Office, German Search Report for German Application No. 102009051536.4, Mar. 23, 2010;.
German Patent Office, German Search Report for Application No. 102009051536.4, dated Mar. 23, 2010.

(Continued)

*Primary Examiner* — Carlos Lugo
(74) *Attorney, Agent, or Firm* — Ingrassia Fisher & Lorenz, P.C.

(57) ABSTRACT

A side door of a motorized vehicle is provided that includes, but is not limited to a latch mechanism adapted to cooperate with a latch member disposed at a door frame, an actuator for locking and/or unlocking the latch mechanism and a coupling means for mechanically coupling (i.e., a mechanical coupling) the actuator and the latch mechanism. A disengagement apparatus is adapted to mechanically disengage the coupling between the actuator and the latch mechanism in response to an external force effect.

16 Claims, 15 Drawing Sheets

OTHER PUBLICATIONS

UK IPO, British Search Report for Application No. 0813625.1, dated Nov. 17, 2008.
German Patent Office, German Search Report for Application No. 102009031744.9, dated Dec. 1, 2009.
USPTO, US Office Action issued in U.S. Appl. No. 12/509,353, mailed Apr. 25, 2011.
Response to US Office Action for U.S. Appl. No. 12/509,353 dated Sep. 26, 2011.
Revised Response to US Office Action for U.S. Appl. No. 12/509,353 dated Oct. 18, 2011.
USPTO, Final Office Action issued in U.S. Appl. No. 12/509,353, mailed Nov. 2, 2011.
UK IPO, British Examination Report for Application No. 0813625.1, dated Dec. 13, 2011.
Appeal Brief for U.S. Appl. No. 12/509,353 dated Jan. 31, 2012.
USPTO, Examiner's Answer issued in U.S. Appl. No. 12/509,353, mailed Mar. 5, 2012.
Response to US Office Action for U.S. Appl. No. 12/509,353 dated Jun. 17, 2011.

* cited by examiner

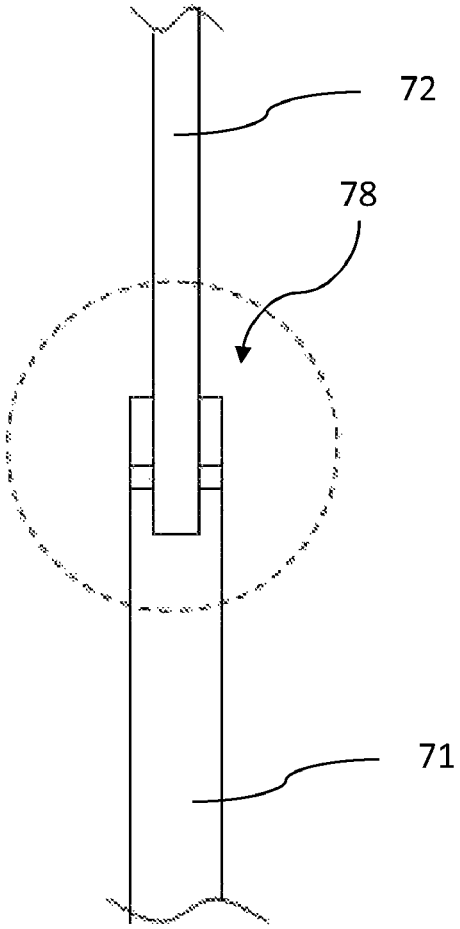
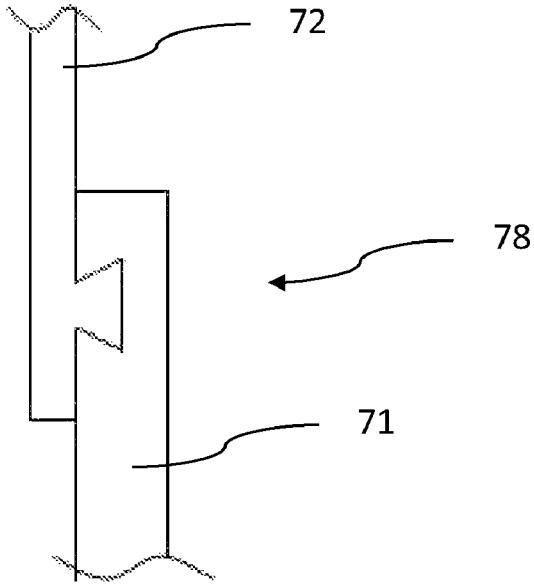
Fig. 20
Fig. 19

VEHICLE SIDE DOOR ASSEMBLY

TECHNICAL FIELD

The present invention is related to a side door of a motorized vehicle that comprises a latch mechanism being adapted to cooperate with a latch member being disposed at a door frame. The side door further has at least one actuator for locking and/or unlocking the latch mechanism and the actuator is disposed at a distance from the latch mechanism.

BACKGROUND

Vehicle doors that comprise a latch mechanism and a corresponding actuator are known in the art. A latch mechanism disposed in the wing of the vehicle door is mechanically linked to a latch-releasing member, such as a door handle, and to a locking or unlocking member, which locks the latch by moving part of the latch mechanism into a position, in which it idles and cannot disengage the latch.

The coupling between the latch mechanism and an actuator in particular for unlatching of the latch mechanism usually takes the form of a pull or push rod. In most vehicle doors, an additional lock rod is provided, which is adapted to transmit the movement of a locking or unlocking member to the latch mechanism. The locking or unlocking member may be designed as a key cylinder and may be disposed in an actuator, such as a handle module, being typically arranged at the outer door panel.

The locking or unlocking member is adapted to switch the latch mechanism either into an idle state or into an active position. In the active position, a movement of a latch-releasing member, such as an inside or outside handle of the vehicle door, may be used in order to disengage the latch mechanism and to open the vehicle door. Even though the coupling between an actuator and the latch mechanism by means of a push/pull rod provides a reliable mechanical coupling, improvements are continually sought for existing assemblies.

GB 1 442 394 discloses a vehicle door having a latch assembly and a locking member, which is movable to a locking position such that subsequent movement of an unlatching member is not transmitted to a detent of the latch assembly. Further, there is provided a latch releasing actuator being connected to the unlatching member by means of an unlatching rod. A further rod is arranged close to the unlatching rod and extends in substantially the same direction. The two rods are arranged in such a manner, that in the event of lateral distortion of the further rod, the resultant tensile force exerted by the further rod on said component of the latch assembly is sufficient to ensure, that the locking member is moved into that locking position.

Such an assembly is rather elaborate and complex. Furthermore, a lock rod interconnecting a key cylinder of a door handle module and a latch mechanism is susceptible to a brute force attack in conjunction with a break-in attempt conducted by a car thief. Hence, a car thief may force a screw driver or a comparable pointed and elongated tool through the outer door panel in order to manipulate the latch mechanism by manually shifting or by mechanically deforming the lock rod in order to unlock the latch mechanism.

In view of the foregoing, at least one aim is to provide an improved vehicle side door and another aim is to provide a greater resistance against brute force break-in attempts. Furthermore, other aims, desirable features and characteristics will become apparent from the subsequent summary and detailed description and the appended claims, taken in conjunction with the accompanying drawings and this background.

SUMMARY

One embodiment of the present invention provides a side door assembly for a motorized vehicle comprising a latch mechanism, which is adapted to cooperate with a latch member, which is disposed at a door frame. The side door assembly further has at least one actuator for locking and/or unlocking the latch mechanism and the actuator is disposed at a distance from the latch mechanism. At least one actuator and the latch mechanism are mechanically coupled by a coupling means. This coupling means transmits a locking or unlocking movement of the actuator to the latch mechanism in order to transform the latch mechanism into an idle, hence locked state or in order to transfer the latch mechanism into an unlocked state, in which by means of a latch-releasing member, the latch mechanism can be unlatched finally leading to an opening of the door.

In particular, an embodiment of the present invention further comprises a disengagement apparatus or disengagement means that are adapted to mechanically disengage the coupling between the actuator and the latch mechanism in response to an external force. The external force may be due to mechanical deformation of the vehicle side door, either in case of a crash or in case of a brute force break-in attempt conducted by a car thief. The disengagement apparatus or disengagement means are adapted to interrupt or to disengage the coupling between the actuator and the latch mechanism in response to such external forces which may arise in a crash situation or which are due to local and distinct mechanical deformations in close vicinity to the door handle, as they may arise in conjunction with a break-in.

By means of the decoupling of the actuator and latch mechanism, the side door can no longer be opened by means of the outside door handle, because the latch mechanism remains in its locked or idle state and it is no longer accessible by means such as a key cylinder arranged in the vicinity of a door handle.

In typical embodiments, the coupling means are designed as lock rod, interconnecting the latch mechanism either with a sill lock button or with a key cylinder disposed in or in the vicinity of a door handle module. Whereas the sill lock button is adapted to transfer a pushing motion to the lock rod in for transferring the latch mechanism in its locked or idle state, the handle module may exhibit a bidirectional force to the lock rod in order to lock as well as to unlock the latch mechanism.

According to a preferred embodiment of the invention, the disengagement apparatus or means comprise a disassembling member, which is mechanically coupled with an outer door panel of the vehicle door and which is further adapted to be shifted at least in cross-vehicle direction in order to disassemble or to destroy the coupling means. The disassembling member is therefore adapted to actively decouple and to mechanically separate the latch mechanism and the actuator in the event that a predetermined external force is exerted into the side door in cross-vehicle direction.

Due to the external force, which may be due to an accident or due to a brute-force theft attack, at least the disassembling member moves and shifts inwards in cross-vehicle direction and mechanically interacts with the coupling means in such a way, that the coupling means become disengaged.

By moving in cross vehicle direction, the disassembling member may also partially separate from the outer door panel. In case of a theft attack, the disassembling member arranged at the inside of the outer door panel may be driven inwardly in response of a tool (e.g., a screw driver) being forced trough the outer door panel. Preferably, the disassembling member has a rigid internal structure withstanding any pointed tool being forced through the outer door panel. In this way, it can be asserted, that the pointed tool will push the disassembling member inwardly, which leads to the intended rupture or disassembling of the coupling means.

According to another preferred embodiment, the disassembling member comprises a mounting portion, which is adapted to be disposed between the outer door panel and a handle module of the vehicle door. The handle module is that part of a door handle, which is mounted at the inside of the outer door panel whereas the handlebar, which is mechanically coupled to the handle module is disposed outside the outer door panel. The disassembling member is preferably designed as sheet metal and comprises a structure and geometry which is adapted to the outer contour of the handle module and the inward facing surface of the adjacent outer door panel.

Further, the disassembling member comprises a protruding portion, which substantially extends in cross vehicle direction. A free end of the protruding portion facing inward and away from the outer door panel is adapted to interact with the coupling means in such a way, that the coupling means are disassembled or at least partially disengaged upon impact with the protruding portion.

The protruding portion may comprise a lateral expansion that corresponds to the distance between the coupling means and the outer door panel. Hence, in an initial position, the free end of the protruding portion may almost be in contact with a coupling means. In this way, it can be ensured, that already a slight deformation induces a lateral movement of the disassembling member finally leading to the indented decoupling between the latch mechanism and the actuator.

The mounting portion as well as the protruding portion may comprise a rather flat and even geometry. The protruding portion and mounting portion of the disassembling member may form an angle of about 90° or less. In typical embodiments, the angle between the protruding portion and the mounting portion is between about 75° and about 85°, preferably around 80°.

According to another embodiment, the mounting portion of the disassembling member and the handle module comprise mutually corresponding positive locking means. In particular, the disassembling member at its mounting portion comprise at least one aperture being adapted to receive at least those portions of the handle module that abut against the inside surface of the outer door panel. Moreover, this aperture further allows an assembly of the handle module at the door panel in such a way, that the disassembling member and its mounting portion is simply squeezed and sandwiched between the handle module and the inside of the outer door panel. In this way, the assembly of the disassembling member at the door structure can be conducted without any further or additional assembling means, like screws or bolts. The aperture of the disassembling member may comprise some inward pointing projections or portions providing a correct adjustment of the disassembling member in order to prevent any misalignment with respect to the position of the handle module.

According to another preferred embodiment, the coupling means comprise an elongated rod, which in turn comprises at least a first and at least a second rod portion, that are interconnected by means of a coupling member which is adapted to disassemble in response to the external force effect. In some embodiments, the coupling member of the elongated rod is actively disassembled by means of the disassembling member being coupled to the outer door panel. In these embodiments, the disengagement apparatus or means are designed as to actively disengage and to actively disassemble a coupling member of the coupling means.

According to other embodiments, it is already sufficient to provide a coupling member which disassembles as soon as it is exerted by a predefined directed external force. For instance, it may already be sufficient to couple the first and the second rod portion to different parts of the door structure. As an example, the first rod portion may be coupled to the outer door panel whereas the second rod portion may be coupled to an inner door panel. As soon as the outer door panel becomes subject to mechanical stress or deformation, the coupling member may disassemble due to the coupling with components that move in cross-vehicle direction.

Alternatively or additionally, the first and second rod portion may also be coupled to a common structural member of the side door, such as the outer or inner door panel. This type of coupling can be achieved by means of a fastening element having a certain elongation along the lock rod and which is coupled with one end portion to the first rod portion and which is further coupled with an opposite end portion to the second rod portion.

This fastening element having two fixing points to the lock rod can be fastened to the structural member of the door. Upon a mechanical deformation of this structural member, the fixing element may disassemble into two pieces between its two end portions, each of which remain fastened to the first and second rod portion, respectively. Due to the disassembling of the fixing element, also the structurally weakened lock rod disassembles in order to decouple the actuator and the latch mechanism.

In another preferred embodiment, the coupling member is adapted to transfer tensile and/or compressive forces, and the coupling member is adapted to disassemble or disengaged when a relative force exerted on the first and second rod portions acting in direction transverse to the elongation of the rod exceeds a predefined threshold. In this way, the coupling member is adapted to transfer push and pull movements and corresponding tensile and/or compressive forces in longitudinal direction of the lock rod. As soon as transverse forces applied to the lock rod exceed a predefined threshold, the coupling member disassembles either reversibly or irreversibly.

Further, the coupling member comprises a first section being connectible to the first rod portion and further comprises a second section that is connectible to the second rod portion. First and second sections of the coupling member are interconnected by means of an intermediate section. The intermediate section is preferably structurally and/or mechanically weakened. In this way, the intermediate section may reliably disengage in a well-defined way, in response to an external force effect. Consequently, first and second sections of the coupling member fall apart in spatially separate from each other. In terms of theft-protection, the separation of first and second sections of the coupling member and a corresponding separation of first and second portions of the lock rod is beneficial, because a lower portion of the lock rod may drop down, where it is almost not reachable from the outside of the vehicle.

According to embodiment of the invention, the coupling member comprises positive locking means for reversibly interconnecting its first and second sections. The mutually corresponding positive locking means of first and second sections of the coupling member may be designed as dovetail allowing for a relative movement of first and second sections of the coping member in cross-vehicle direction but which provides transmission of tensile and compressive forces. Other positive locking or positive fitting arrangements may for instance comprise a cylindrically shaped bolt being movably disposed in a correspondingly shaped receptacle, and the bolt and receptacle are movable with respect to each other in cross-vehicle direction.

Additionally, the lock rod may comprise a bended end portion being adapted to be received in receptacle which in turn is directly connected or coupled to the latch mechanism. The receptacle may comprise an opening facing in cross-vehicle direction, thus allowing a sideward movement of the bended end portion of the lock rod into and out of the receptacle.

According to another embodiment, the coupling member comprises a sleeve-like geometry. The first and second sections of the coupling member, which are separately connectible with first and second portions of the lock rod, respectively, comprise a blind hole, which is adapted to receive an end portion of the first and/or second rod portion. The intermediate section being preferably reduced in diameter compared to the first and second section. Due to its reduced size, the intermediate section provides a kind of fracture site.

In preferred embodiments, the intermediate, weakened section of the coupling member is arranged directly opposite the free end of the protruding portion of the disassembling member. Moreover, the height and extension of the intermediate section is adapted to the geometry, in particular the thickness of the sheet metal of the disassembling member.

Furthermore, it is intended, to design the coupling member as injection molded component by making use of thermoplastic material. Hence, a bonding of the respective portions of the lock rod and the coupling member can be integrated in an injection molding process. Alternatively, the sleeve-like coupling member may be manufactured separately and may be attached to first and second portions of the lock rod during assembly of the latter in a vehicle door.

Additionally or alternatively, the coupling member may comprise a material having different shear modulus in transverse and longitudinal direction. In this way, the coupling member may already provide the required mechanical properties, even without a particular outer shape. The following examples further illustrate the idea and advantages. The given examples are only illustrative and not restrictive and are not to be construed to limit the scope.

BRIEF DESCRIPTION OF THE DRAWINGS

The present invention will hereinafter be described in conjunction with the following drawing figures, wherein like numerals denote like elements, and FIG. 1 schematically illustrates a rear door arrangement of a vehicle;

FIG. 19 illustrates another dovetail-based positive locking of lock rod portions;

FIG. 20 shows a side view of the embodiment according to FIG. 19;

DETAILED DESCRIPTION

The following detailed description is merely exemplary in nature and is not intended to limit application and uses. Furthermore, there is no intention to be bound by any theory presented in the preceding summary and background or the following detailed description.

Figure 1:
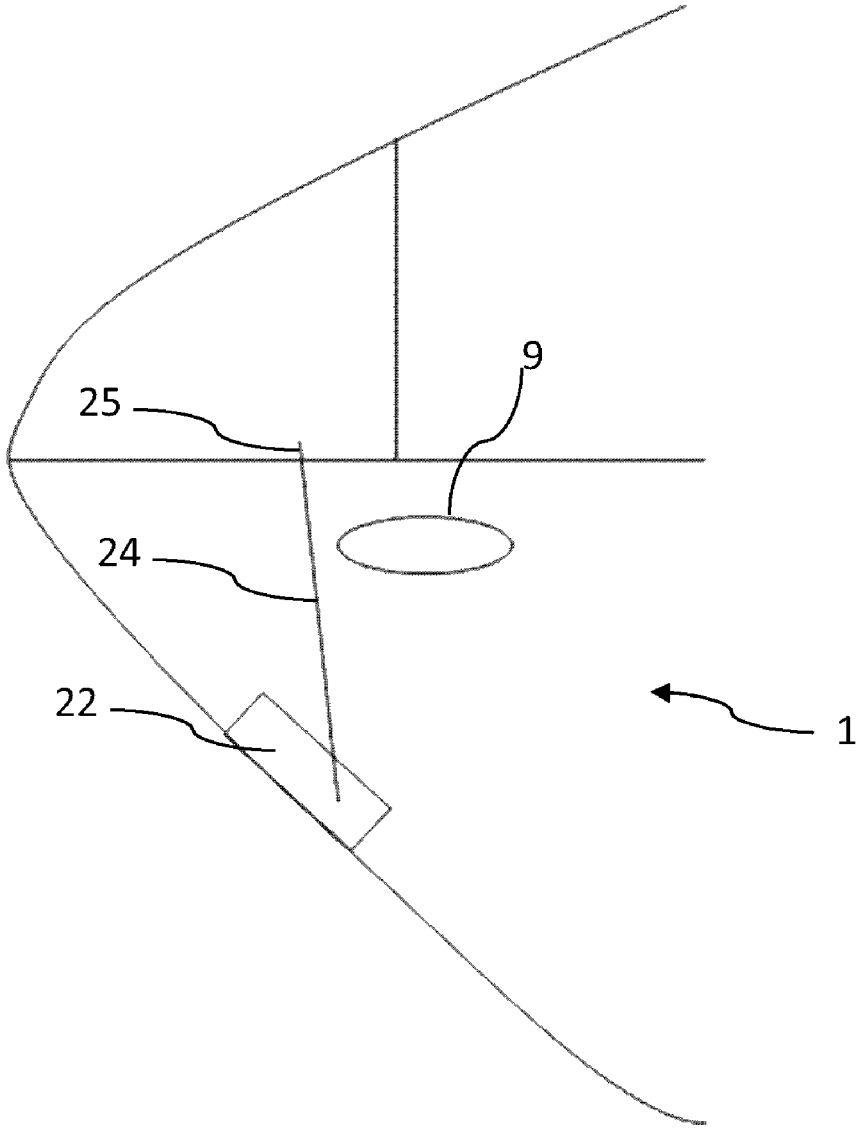

This schematic illustration of FIG. 1 shows a vehicle door 1, in particular a rear door of a car, that comprises a latch mechanism 22 and a lock rod 24 serving as coupling means between the latch mechanism 22 and a sill lock button 25. Further, a handlebar 9 is indicated which is separately coupled to the latch mechanism 22 by means of a not explicitly illustrated latch releasing member. The lock button 25 and the lock rod 24 are adapted to switch the latch mechanism 22 between a locked and an unlocked state. In its locked state, the latch mechanism 22 typically idles. Hence, any latch releasing motion provided by the handlebar 9 does not have any effect on the latch mechanism and does not lead to a latch release.

Figure 2:
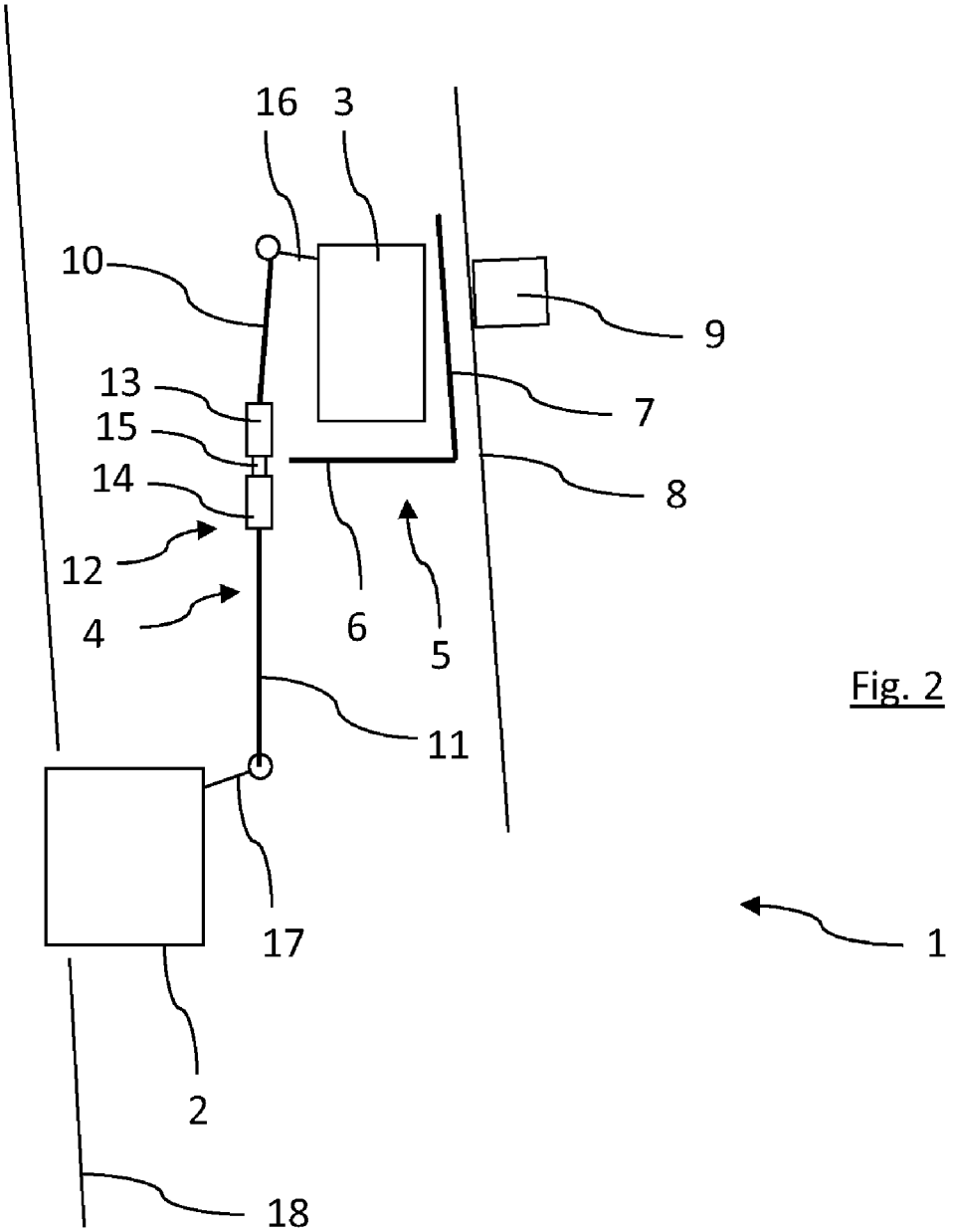
FIG. 2 shows a schematic illustration of a vehicle door in cross section.

FIG. 2 schematically illustrates another embodiment of the invention, which is predominantly applicable to a front door of a vehicle comprising a latch mechanism 2, an outer door panel 8, an inner door panel 18 and a handlebar 9 protruding from the outer door panel 8. At the inside of the outer door panel 8, there is arranged a handle module 3, which is mechanically coupled to the latch mechanism 2 by means of a lock rod 4.

The latch mechanism 2, as well as the handle module 3, comprise a lever 16, 17 in particular a bell crank lever. By means of pivoting the bell crank lever 17 of the latch mechanism 2, the latch mechanism can be switched between an idle and an unlocked state. In the unlocked state, a latch-releasing action of the handlebar 9 leads to a release of a not illustrated latch member, which is disposed at the door frame. Actuation of a latch-releasing is provided by another mechanical coupling between the handle module 3 and the latch mechanism 2, which is not further illustrated in the figures. The lever 16 of the handle module 3 is not coupled to the handlebar 9. Instead, it is pivoted in response to a twisting motion of a lock cylinder.

The mechanical coupling between the handle module 3 and the latch mechanism 2 is provided by a lock rod 4 comprising a first, upper rod portion 10 and a second, lower rod portion 11. The two rod portions 10, 11 are interconnected by means of a coupling member 12, which has a sleeve-like geometry and which is further illustrated in FIGS. 10 and 11. The coupling member 12 comprises an upper, first section 13 and a lower, second section 14, each of which comprising a blind hole being adapted to receive an end portion of the first rod portion 10 and the second rod portion 11, respectively.

The two sections 13, 14 of the coupling member 12 are interconnected by means of an intermediate section 15, being reduced in diameter compared to the first and second sections 13, 14. The intermediate section 15 is adapted to provide a site of fracture in order to disassemble and to disengage the mechanical coupling between the handle module 3 and the latch mechanism 2.

In the embodiments according to FIGS. 2-8, an L-shaped disassembling member 5 is designated to actively disengage or to disassemble the coupling member 12 in the area of its intermediate section 15. The disassembling member 5 has a mounting portion 7 and a protruding portion 6 substantially protruding in cross-vehicle direction. With its protruding portion 6, the disassembling member 5 is adapted to interact with the coupling member 12 in response to an at least punctual deformation of the outer door panel 8, which is typically due to an external force effect.

The external force effect leading to a rupture or break of the coupling member 12 can be due to a crash-based deformation of the outer panel or it may be due to a break-in attempt of a theft, forcing a pointed tool, like a screw driver, trough the outer door panel 8 in close vicinity to a key cylinder or to a handlebar 9 of the vehicle door. In either case, referring to FIG. 2, the disassembling member 5 shifts to the left and impinges the coupling member 12 in the area of its intermediate portion 15. This may lead immediately to a disassembling of the coupling member 12 and to a corresponding disassembling of the lock rod 4.

Figure 3:
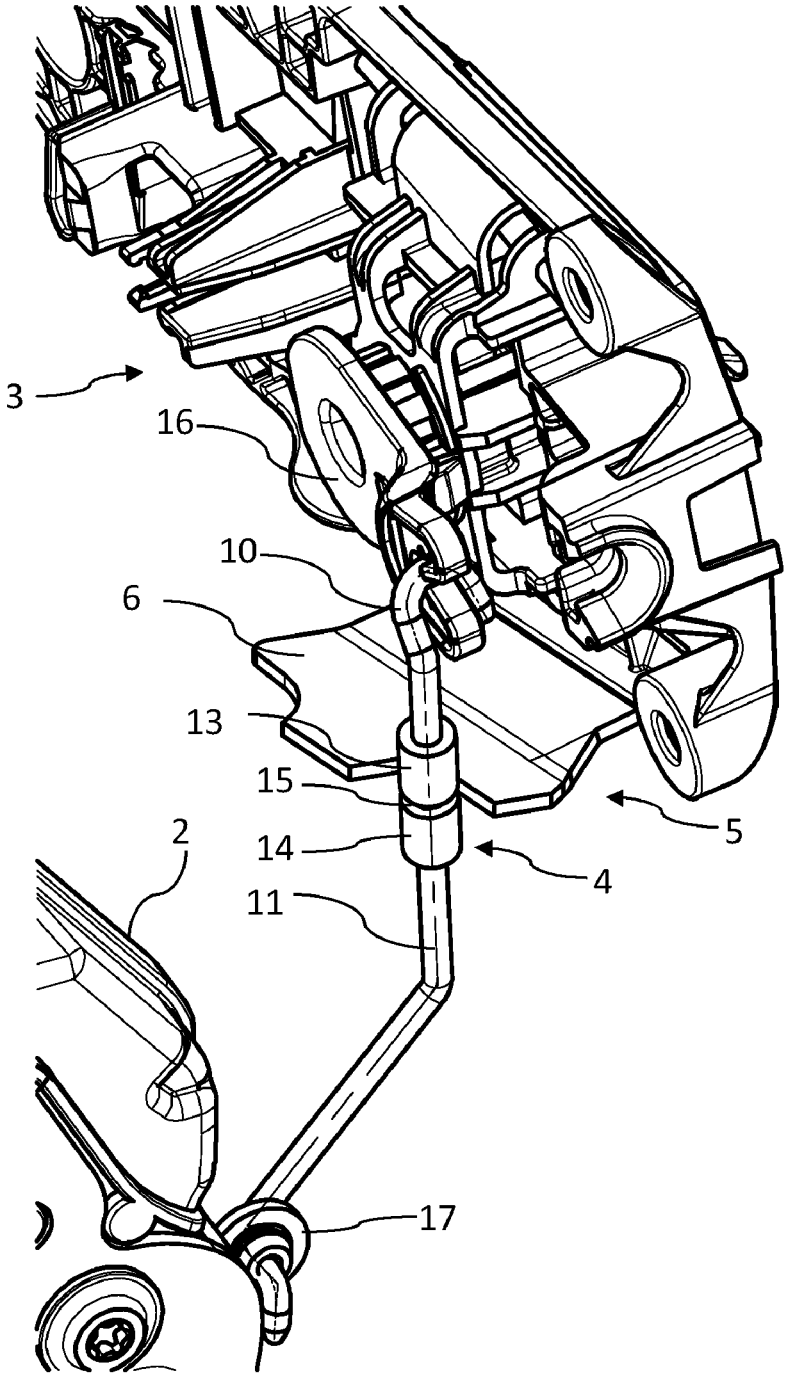
FIG. 3 depicts a detailed perspective view of a handle module, a latch mechanism and an interconnecting lock rod.
Figure 4:
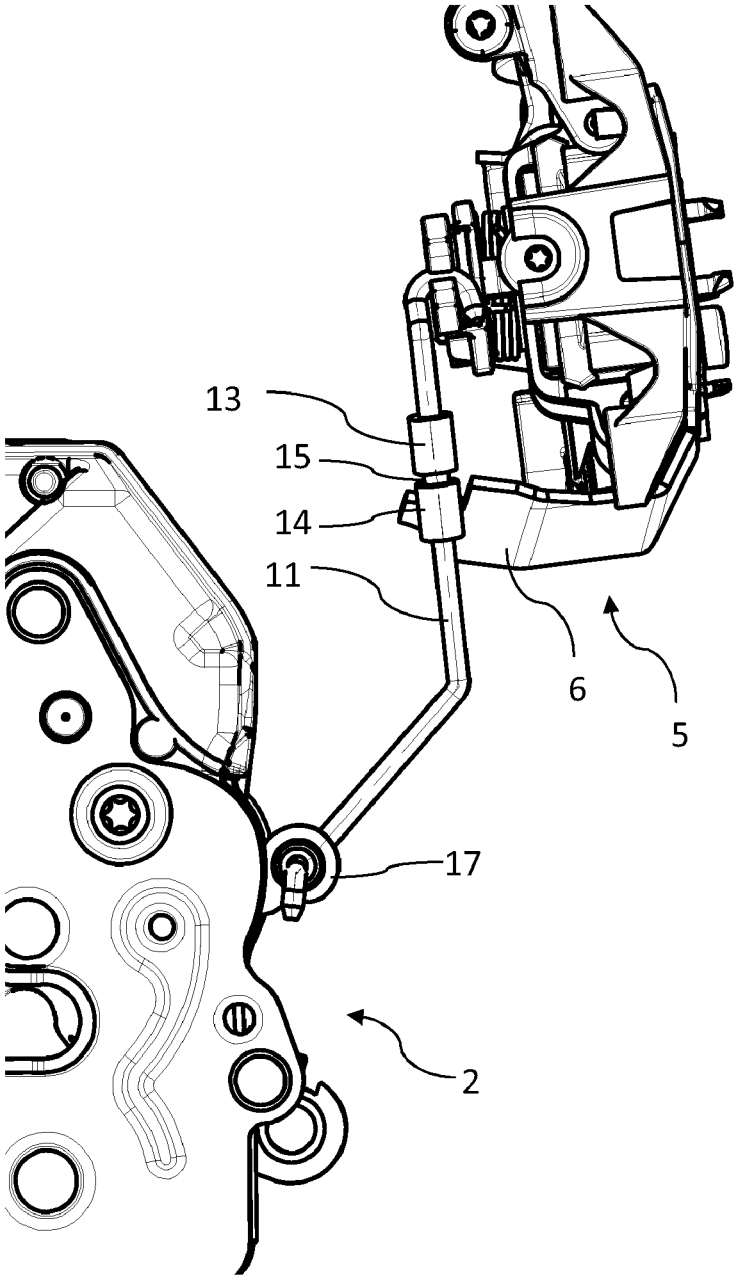
FIG. 4 shows the embodiment according to FIG. 3 in another perspective view.
Figure 5:
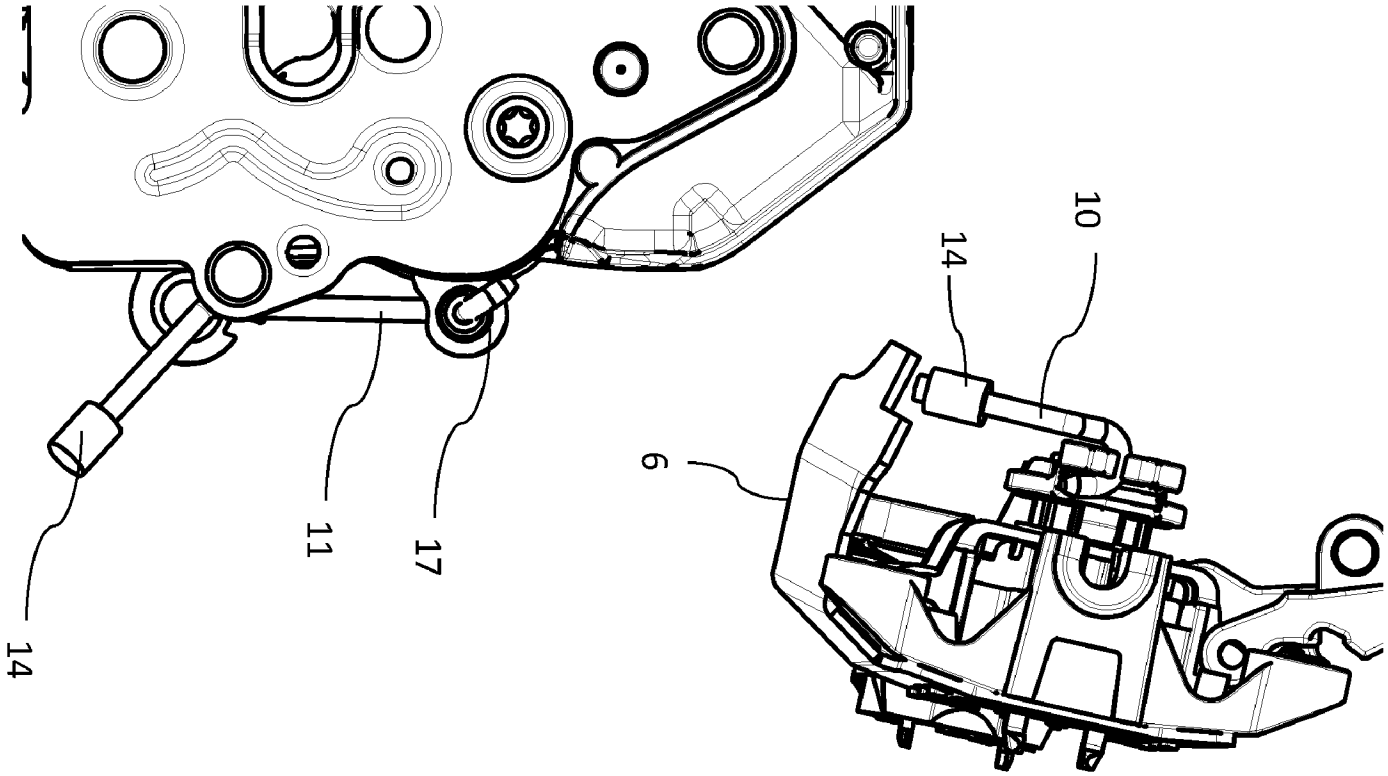
FIG. 5 illustrates the embodiment according to FIGS. 3 and 4 in which handle module and latch mechanism are decoupled.

FIGS. 3 and 4 depict the mechanical coupling between the handle module 3 and the latch mechanism 2 in different perspective illustrations. FIG. 5 shows a situation, where the disassembling member 5 has been shifted to the left hand side due to a side impact, either in a crash situation or due to a brute-force break-in attempt. As can be seen from FIG. 5, due to penetration of the disassembling member 5, the lock rod disassembles and the lower, second portion 11 turns over and finally points downward, which makes it even more difficult for a thief to pivot the bell crank lever 17 upwards in order to unlock the latch mechanism 2. In the configuration as illustrated in FIG. 5, the latch mechanism remains in its idle state and consequently, any handle-induced action has no effect to the latch mechanism 2.

FIGS. 6 through 9 show the disassembling member 5 in various perspective views. As can be seen from FIG. 8, the protruding portion 6 and the mounting portion 7 form an angle of about 80 degrees. The overall geometry of the disassembling member 5 is governed by the geometry of the outer door panel 8 and the geometry of the handle module 3. The mounting portion 7 of the disassembling member 5 comprises an aperture 19, which receives those portions of the handle module 3, which are designed to get in direct contact with the inner surface of the outer door panel 8 in a final assembly position, which is indicated in FIG. 4. In this way, conventional fastening means of the handle module 3 but also mechanical and electrical activating means, that have to be coupled to the handle bar 9, have not to be redesigned because of the disassembling member 5 being additionally disposed in the door structure.

Figure 6:
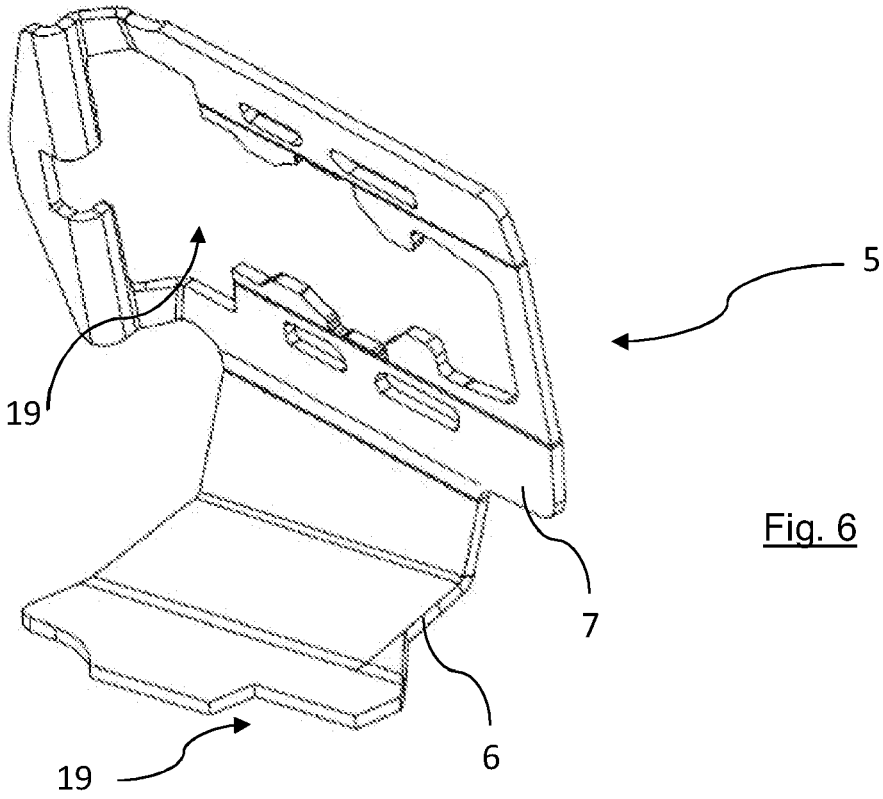
FIG. 6 in a perspective view illustrates the disassembling member.
Figure 7:
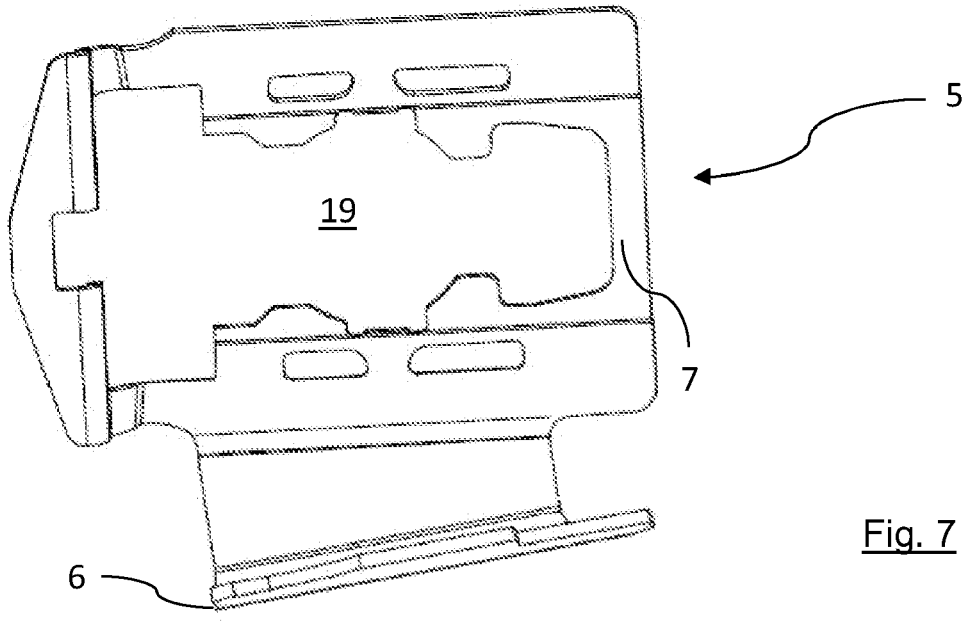
FIG. 7 shows the disassembling member as seen in cross-vehicle direction.
Figure 8:
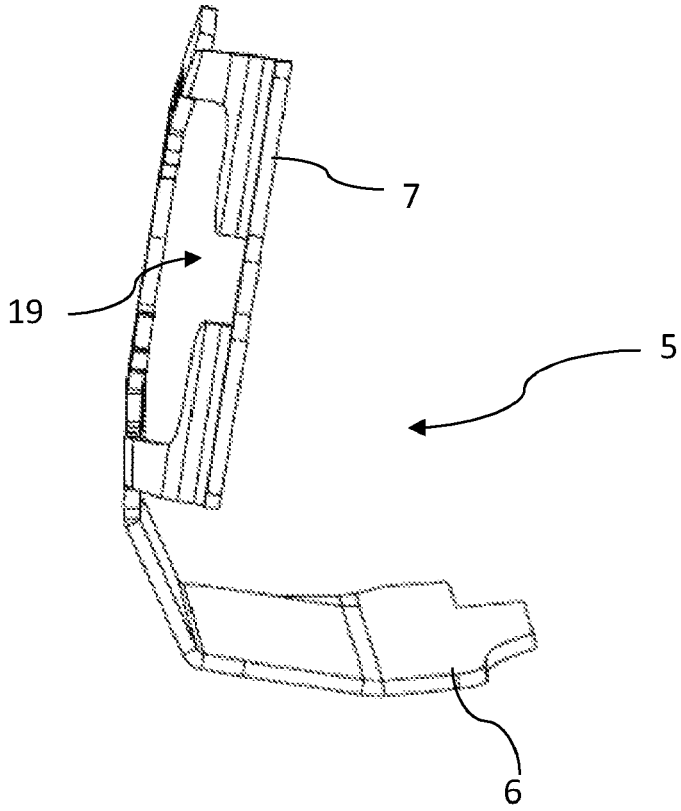
FIG. 8 shows the disassembling member as seen in direction of the vehicle long axis.

As can be seen from FIGS. 6 and 7, the aperture 19 has inward pointing or inwardly protruding portions, which may positively engage with corresponding depressions or cavities of the handle module 3 or the door panel. In this way, a firm and tight fixing of the disassembling member 5 sandwiched between outer door panel 8 and handle module 3 can be achieved, even without additional fastening elements. Furthermore, the shape and geometry of the disassembling member 5 is designed such that it fits and corresponds to the contour and geometry of existing handle modules 3 and door panels 8. In can therefore, easily embedded in an existing production run.

Figure 9:
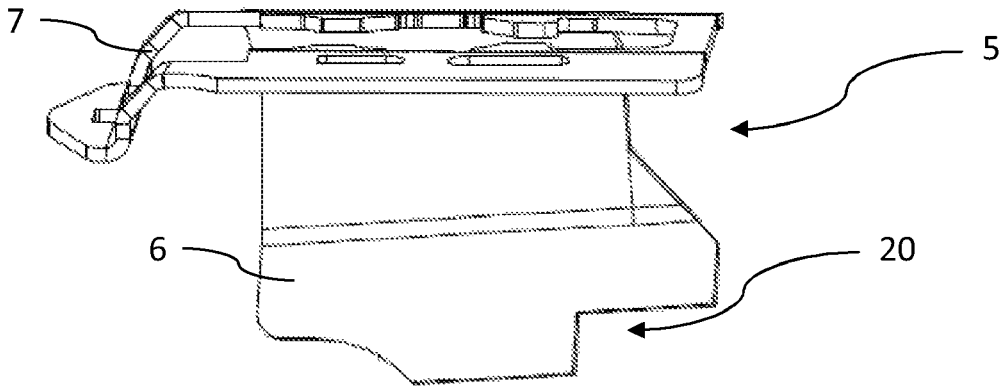
FIG. 9 illustrates the disassembling member from above.

Additionally, as can be seen in FIG. 9, the protruding portion 6 of the disassembling member 5 has a receptacle 20 formed by two borders or edges that extend at an angle of about 90 degrees with respect to each other. These two edges forming the receptacle 20 both may impinge the coupling member 12. In this way, an even more reliable disassembling of the lock rod 4 can be provided.

Apart from the corner-shaped receptacle, also curved and concave corrugated receptacles are conceivable and are in the scope of the present invention, which may at least partially surround the coupling member even in an initial unstressed configuration.

Even though, the embodiment as illustrated in FIGS. 2 through 11 is explicitly shown for a coupling between a handle module 3 and a latch mechanism, it may be correspondingly applied to the mechanical coupling between a sill lock button 25 and a latch mechanism 22 as schematically illustrated in FIG. 1.

Figure 10:
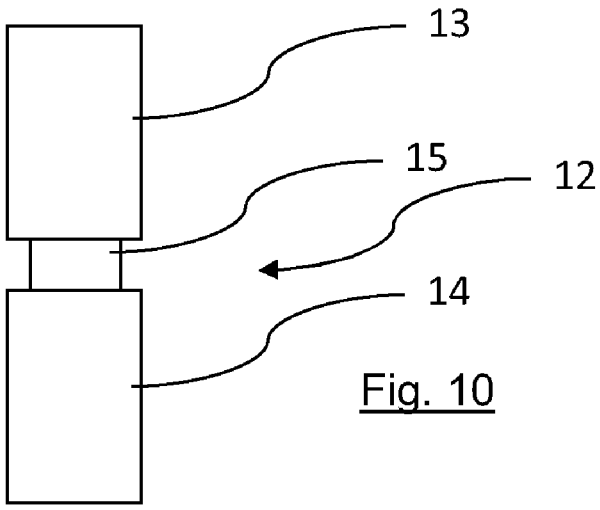
FIG. 10 shows the coupling member in a sleeve-like embodiment in a side view.
Figure 11:
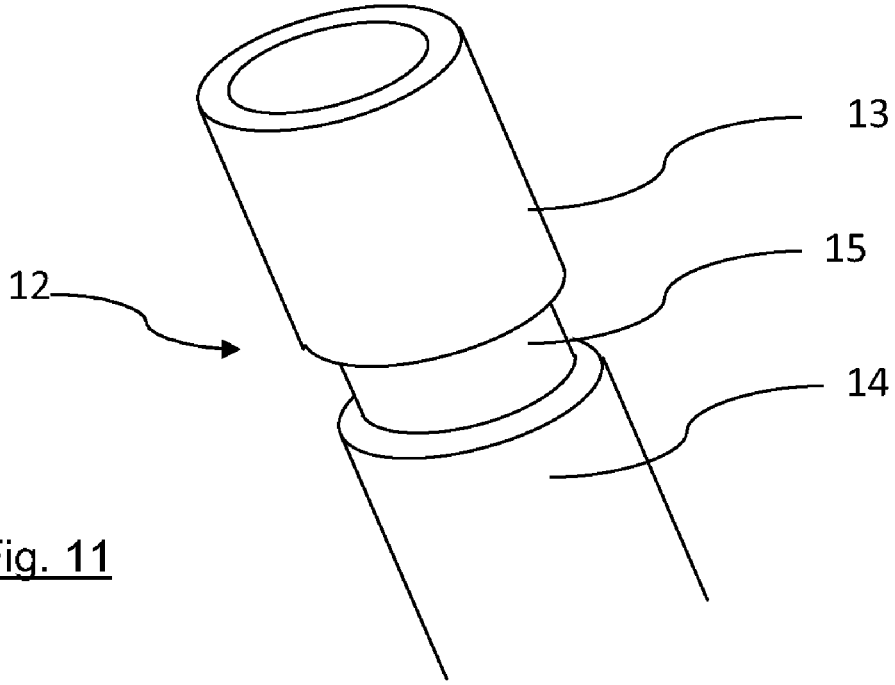
FIG. 11 illustrates the coupling member according to FIG. 10 in a perspective view.

The coupling member as given in FIGS. 10 and 11 is designed as injection molded component and may comprise a thermoplastic material. The first and second rod portions 10, 11 can be directly interconnected during an injection molding process. Alternatively, each rod portion 10, 11 may be threaded into the respective end of the coupling member 12. Additionally or alternatively, the material for the sleeve-like coupling member 12 may have an isotropic shear modulus, such that the sleeve has a rather high resistivity with respect to tensile and compression loads, allowing for a normal operating of the lock rod. However, under shear loads, the sleeve will easily fracture at the intermediate portion 15.

Figure 12:
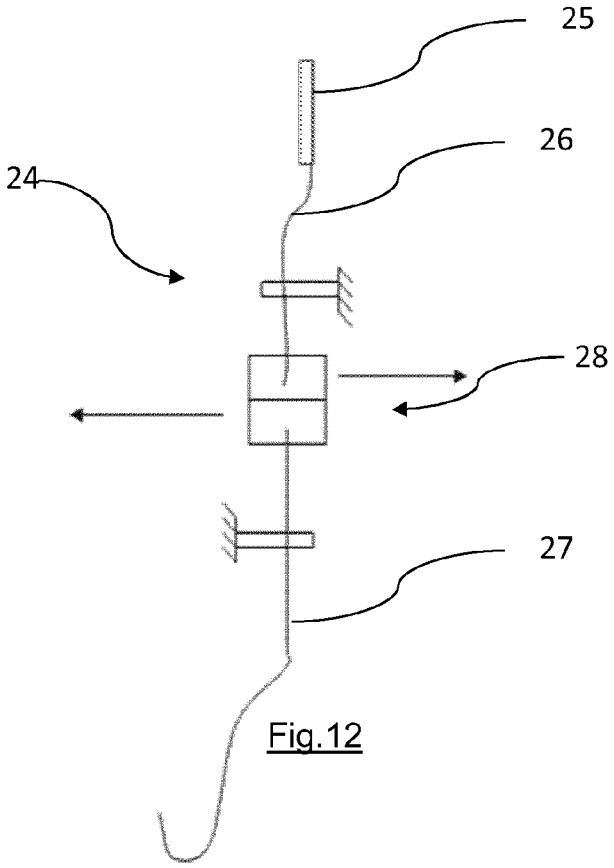
FIG. 12 schematically illustrates a coupling between a sill lock button and the latch mechanism without a disassembling member.
Figure 13:
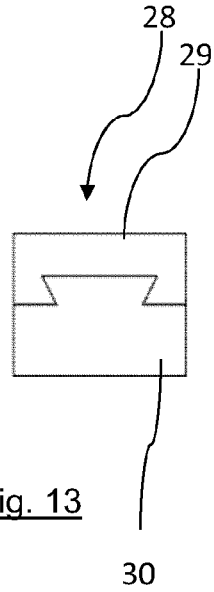
FIG. 13 in an enlarged view illustrates the coupling member of FIG. 12.

The embodiments illustrated in FIG. 12 and 13 refer to the coupling between a sill lock button 25 and a latch mechanism 22 as depicted in FIG. 1. Here, the lock rod 24 also has an upper portion 26 and a lower portion 27, that are interconnected by means of a coupling member 28, which has an upper part 29 and a lower part 30 being positively engage by means of a dovetail-like geometry. The upper rod portion 26 together with the upper part 29 of the coupling member 28 is mechanically coupled to an outer door panel, whereas the lower part 27 of the lock rod 24 and the lower part 30 of the coupling member 28 are mechanically coupled to an inner door panel.

As soon as an external force effect leads to a deformation of either inner or outer door panel, which is likely to happen in an accident, the upper and lower parts 29, 30 of the coupling member 28 disengage in order to decouple the lock button 25 from the rod 27 and the latch mechanism. In this way, a crash-induced deformation of the upper section 26 of the lock rod 24, for example, is less likely to unlock the latch mechanism. Hence, the potential for an inadvertent release of the latch can be reduced.

Figure 14:
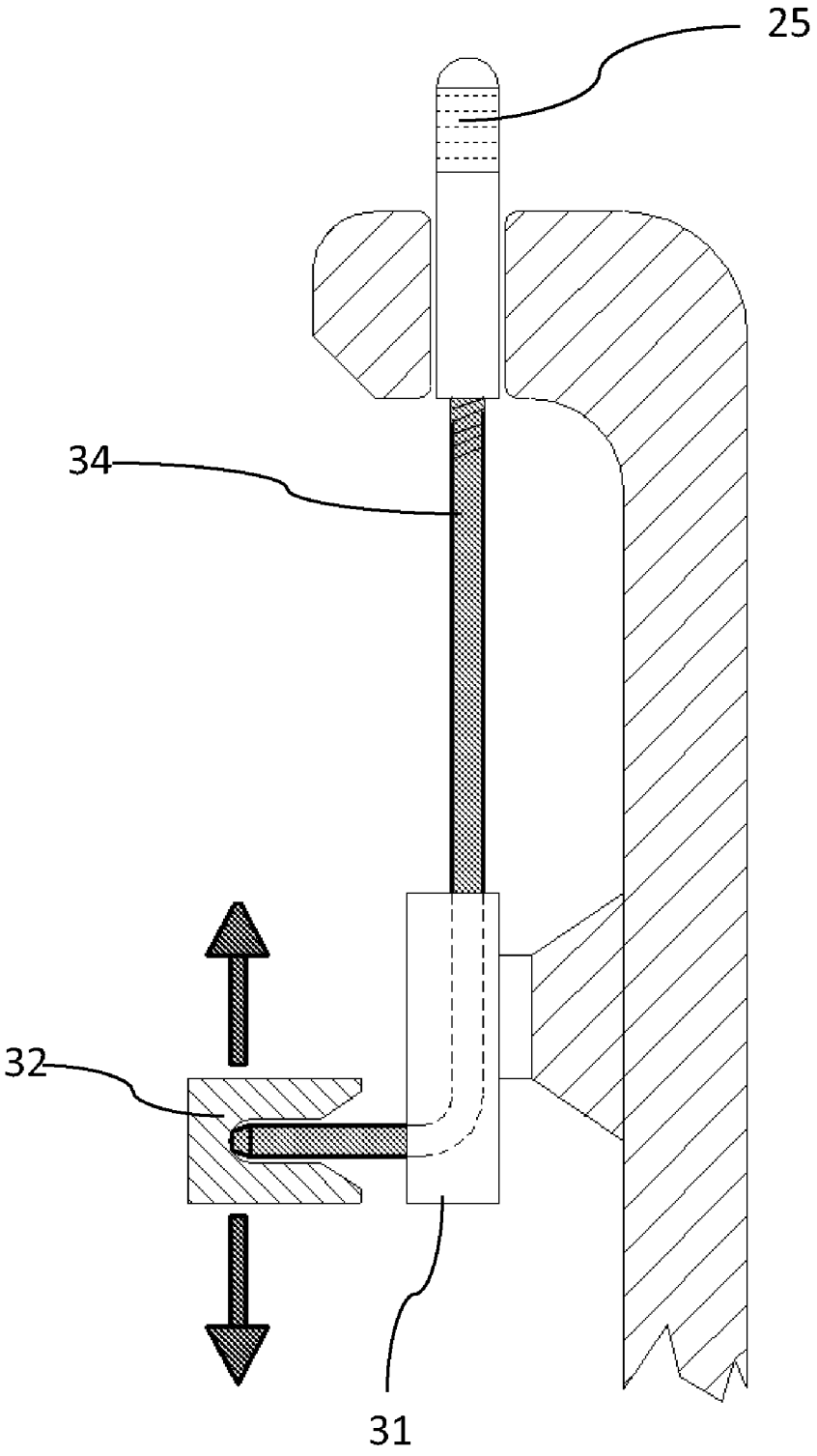
FIG. 14 shows another coupling of a lock button to a latch locking lever.

FIG. 14 shows another embodiment of a mechanical coupling between a lock button 25 and a latch mechanism, in particular its latch locking lever 32. The latch locking lever 32 comprises a receptacle being opened in cross-vehicle direction and which serves to receive an end portion of the lock rod 34 pointing in cross-vehicle direction. The movement of the lock rod 34, which may be activated by the lock button 25 is vertical, in order to move the latch locking lever 32 into an unlocked or into an idle, hence locked, state.

Additionally, there is a guiding structure 31, which provides a compulsory guide for the lock rod in the vertical direction. The guiding structure 31 is further mechanically coupled to a trim pad or to an outer door panel. As soon as the trim pad or the outer door panel becomes subject to mechanical (e.g., crashed-induced or break-in-induced) deformation, the lower end portion of the lock rod 34 may slip out of the receptacle formed in the latch locking lever 32 and decouples the latch mechanism and the lock button 25 from each other.

Figure 15:
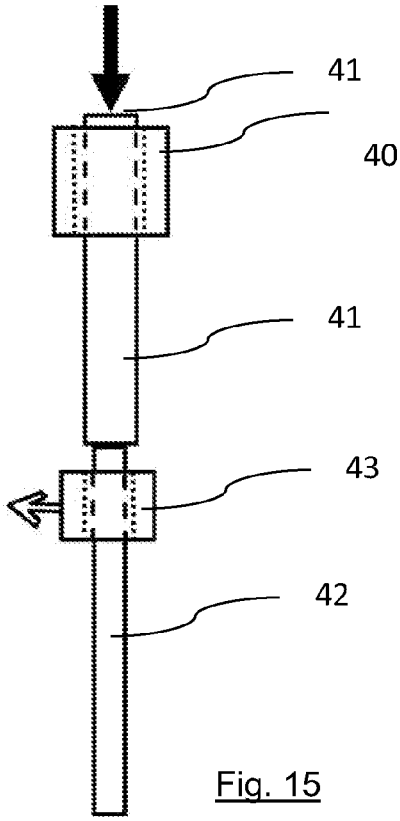
FIG. 15 shows a coupling of a lock button to a lock rod in the locked configuration.
Figure 16:
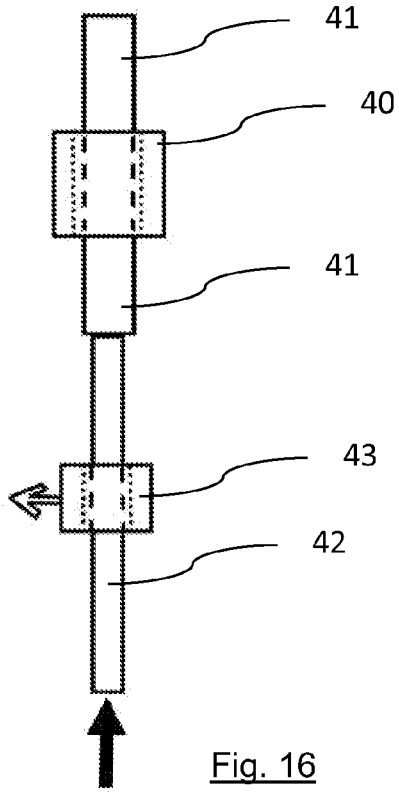
FIG. 16 illustrates the lock button and associated lock rod in unlocked state.
Figure 17:
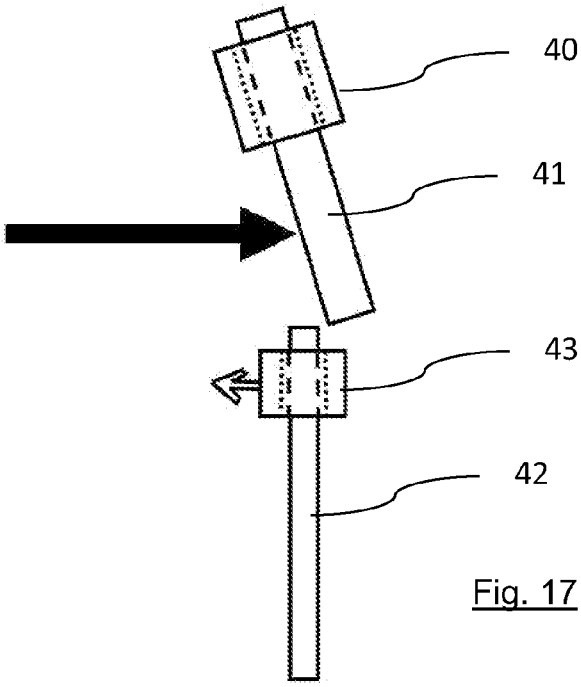
FIG. 17 illustrates the embodiments according to FIGS. 15 and 16 in a decoupled state.

FIGS. 15 to 17 schematically illustrate another embodiment on how to decouple an actuator 41 and a corresponding latch mechanism. Here, a lock button 41, which is guided by a bezel 40, may be pushed down by a user in order to transfer a compressive force to the lock rod 42. With its lower end, the lock rod is coupled to the latch locking lever of the latch mechanism. By pressing down the button 41, as illustrated in FIG. 15, the latch mechanism is switched into the locked, hence idle state. Further, there is provided a rod clip 43, being adapted to fix the lock rod 42 inside the door structure. The rod clip provides a compulsory guide for the lock rod 42 and therefore only allows up and down movements of the lock rod. The bezel 40 is integrated or mechanically coupled to the outer door panel assembly. The rod clip in turn is preferably coupled to the inner door panel.

In the embodiment according to FIGS. 15 to 17, the lock button 41 and the lock rod 42 are only in mechanical contact, and may abut to each other, but are not mutually connected. In this way, the button 41 only provides a unidirectional actuator for locking the latch mechanism. Upon unlocking, which is done by some other electromechanical means, for example, the lock rod 42 exerts an upward pointing compressive force to the button and pushes the button upwards into its initial configuration, which is depicted in FIG. 16. In case of an external force effect, due to which the inner and/or outer door panel may become subject to mechanical deformations, a direct decoupling of lock button 41 and lock rod 42, as illustrated in FIG. 17 is achieved.

Figure 18:
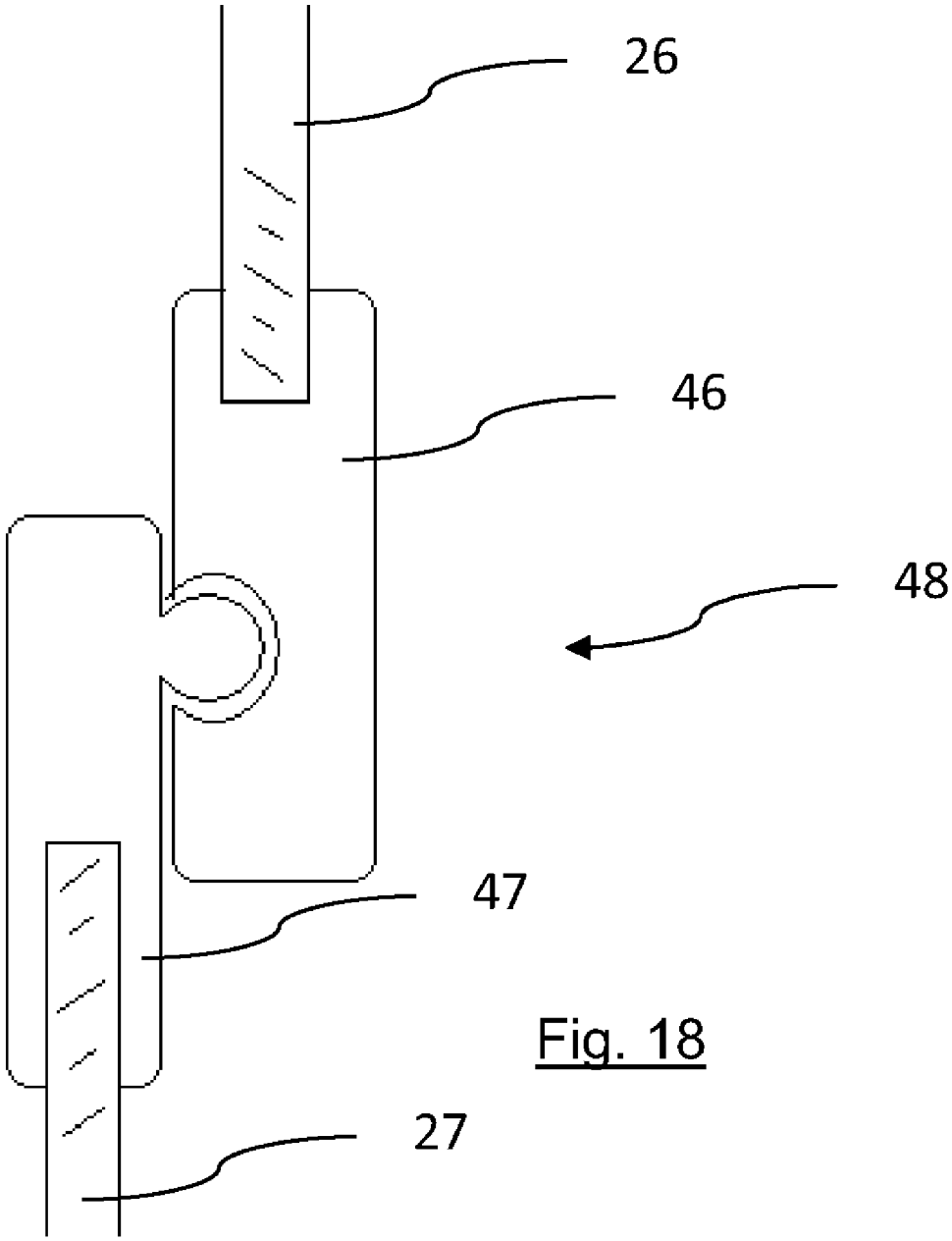
FIG. 18 in a side view illustration shows another positive locking of lock rod portions.

FIG. 18 schematically shows an alternative way of providing a positive engagement between the various rod portions 26, 27. Here, an upper part 46 of the coupling member 48 comprises a somewhat circular shaped receptacle having a cylinder-like geometry and extending in cross-vertical direction, whereas its counterpart 47 has a corresponding, protruding bolt-like portion being adapted to slide along cross-vehicle direction in the corresponding receptacle of part 46.

In FIGS. 19 and 20, a comparable positive-locking solution is illustrated. In contrast to the embodiment according to FIGS. 12 and 13, here the dovetail coupling is tilted at an angle of about 90 degrees. In FIG. 19, the cross-vehicle direction extends horizontal and the dovetailed coupling 78 provides a reliable transfer of tensile and compressive forces by means of the upper and lower portions 72, 71 of the lock rod. As soon as horizontally directed forces apply, the dovetail coupling disassembles.

Figure 21:
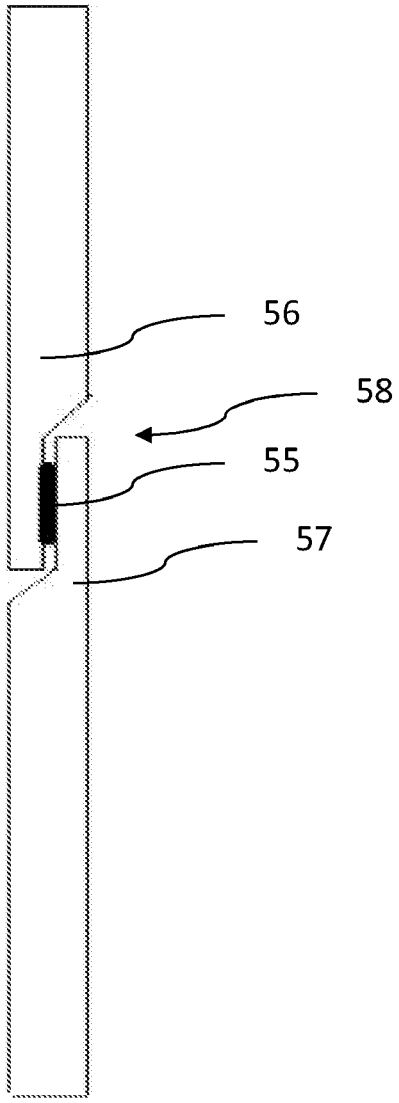
FIG. 21 depicts an attachment of lock rod portions by means of an adhesive.

FIG. 21 illustrates another embodiment, where an upper portion 56 and a lower portion 57 of the lock rod are coupled by means of an adhesive 55 (e.g., an epoxy adhesive). For this purpose, the lock rod portions 56, 57 comprise flat stamped ends, which is beneficial in terms of constructed space saving. Here, the epoxy adhesive provides a disintegrable non-reversible coupling or decoupling of the lock rod portions 56 and 57.

Figure 22:
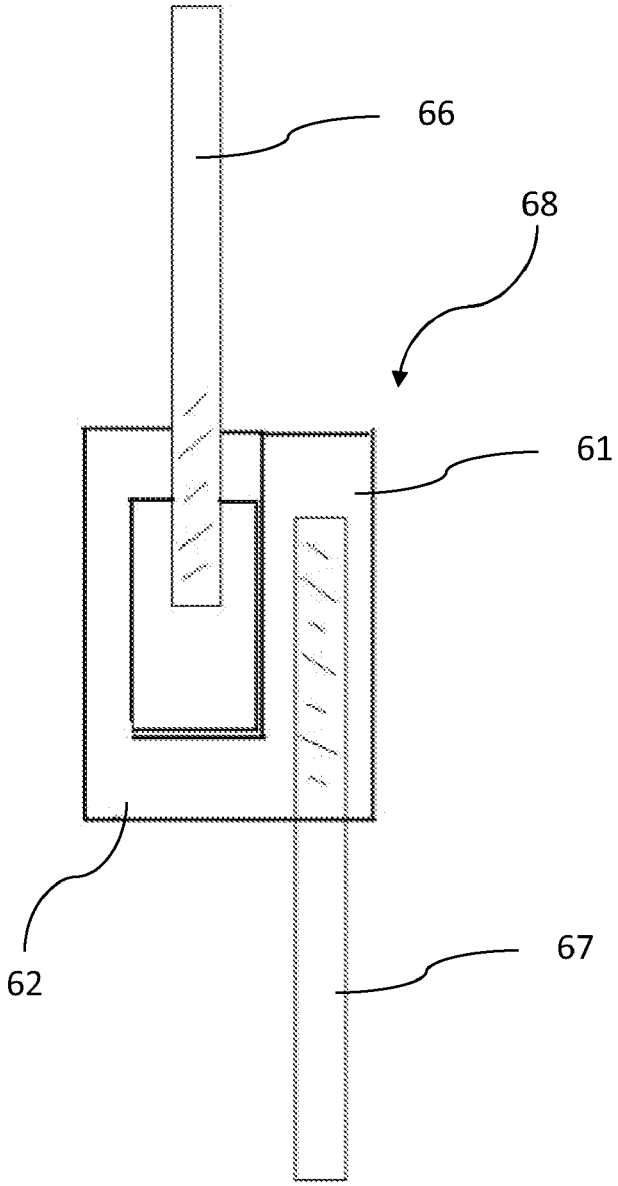
FIG. 22 schematically illustrates a molded plastic corpus in combination with predetermined fractures.

FIG. 22 depicts another embodiment on how to mechanically couple first and second lock rod portions 66, 67. Here, a molded plastic component is provided, that has two portions 61 and 62 being adapted to receive end sections of first and second rod portions 66, 67. The two portions 61, 62 of the molded plastic component 68 are designed such that they break or separate with respect to each other upon a lateral impact load. Therefore, the two portions 61, 62 of the component 68 may comprise definite sections and portions, which break or crack under a predetermined impact load.

Figure 23:
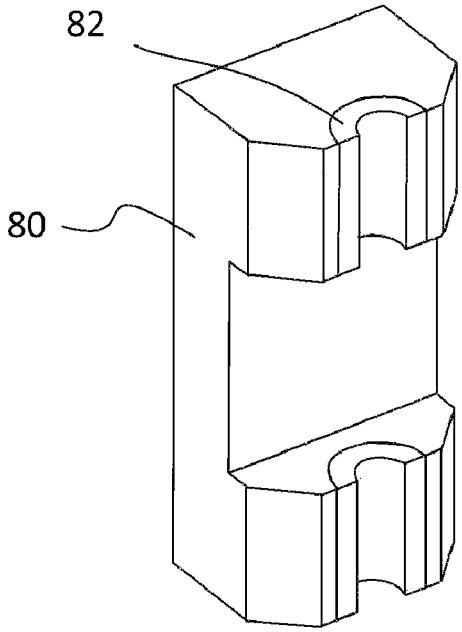
FIG. 23; depicts a further embodiment of a coupling member.
Figure 24:
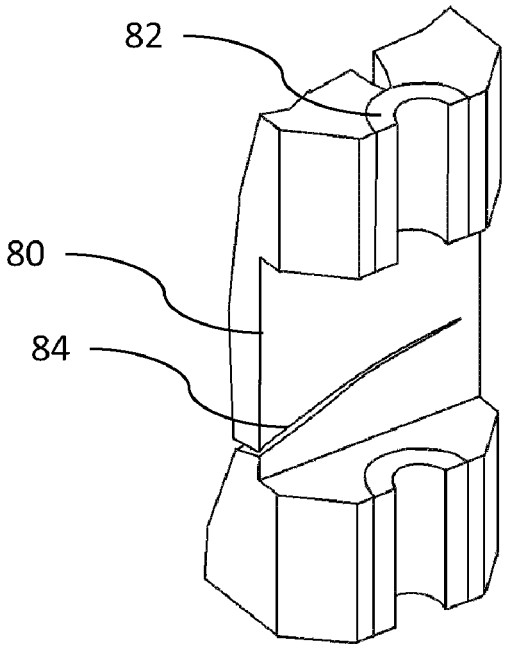
FIG. 24 shows the coupling member according to FIG. 23 after an impact.

FIGS. 23 and 24 illustrate another embodiment of a coupling member 80 comprising a semi-circular slot 82, in which the rod can slide parallel to its direction of elongation. This semi-circular slot-like sleeve 82 may be designed as nylon sleeve and may be embedded into the coupling member 80, which can be designed as injection molded component. Also, the entire coupling member 80 may comprise a piece of foam, which may be attached or fastened to the outer door panel of the automotive door structure by means of an adhesive.

The coupling element as illustrated in FIGS. 23 and 24 is further adapted to develop at least one crack 84 in response of an impact-based deformation of the outer door panel. Since the coupling member 80 is adapted to guide first and/or second rod portions in respective upper and lower sleeve 82, a deformation or a crack 84 of the coupling member 80 may lead to the intended disengagement of first and second rod portions.

Even though usage of a disassembling member 5 is only illustrated in combination with a fragile coupling member 12 in FIGS. 2 to 11, the disassembling member 5 may also arbitrarily combined with those coupling means as described with reference to FIGS. 12 to 22. Additionally, instead of a fragile coupling member 12 in FIGS. 2-9 also positive engaging coupling means, as illustrated in FIGS. 12, 13, 14, 18-20 may be applied in combination with the disassembling member 5.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A side door of a motorized vehicle, comprising:

a latch member;

a latch mechanism configured to cooperate with the latch member, the latch member being disposed at a frame of the side door;

an actuator configured to lock and unlock the latch mechanism and disposed at a distance from the latch mechanism;

a mechanical coupling configured to mechanically couple the actuator and the latch mechanism, the mechanical coupling comprising an elongated rod having a first rod portion and a second rod portion interconnected by a coupling member that is configured to disassemble in response to an external force effect, wherein the coupling member comprises a positive lock configured to reversibly interconnect a first section and a second section of the coupling member; and a disengagement apparatus configured to mechanically disengage the mechanical coupling at the positive lock in response to the external force, wherein the disengagement apparatus comprises a mounting portion being disposed between an outer door panel of the motorized vehicle and a handle module of a side door, the mounting portion and the handle module comprise a mutually corresponding lock.

2. The side door according to claim 1, wherein the disengagement apparatus is further configured to be shifted at least in a cross-vehicle direction in order to disassemble the mechanical coupling.

3. The side door according to claim 2, wherein the mounting portion being disposed between the outer door panel and a handle module of a side door comprises a disassembling member, wherein the handle module is mounted at the inside of the outer door panel.

4. The side door according to claim 2, wherein the disassembling member further comprises a protruding portion substantially extending in a cross-vehicle direction, wherein a free end of the protruding portion facing away from the outer door panel is configured to interact with the mechanical coupling.

5. The side door according to claim 1, wherein the positive lock comprises a semicircular shaped receptacle extending in the cross-vertical direction and a counterpart comprising a semicircular shaped protrusion configured to move slidably in a cross-vehicle direction in the semicircular shaped receptacle.

6. The side door according to claim 1, wherein the coupling member is configured to transfer forces and to disassemble when a relative force exerted on the first rod portion and second rod portion in a direction transverse to an elongation exceeding a predefined threshold.

7. The side door according to claim 1, wherein the first rod portion is coupled to the outer door panel and the second rod portion is coupled to an inner door panel.

8. The side door according to any of the claims 1, wherein the coupling member comprises a first section configured to connect to the first rod portion and further comprises a second section configured to connect to the second rod portion, and a first section and a second section of the coupling member is interconnected with an intermediate section.

9. The side door according to claim 8, wherein the intermediate section is structurally weakened.

10. The side door according to claim 1, wherein the positive lock comprises a dovetail coupling with the dove tail slidably connected in the cross-vehicle direction.

11. The side door according to claim 1, wherein the coupling member comprises a material comprising different shear moduli in each of a transverse and a longitudinal direction.

12. The side door according to claim 1, wherein the positive lock comprises adhesive that is releasably adhering the first rod portion and the second rod portion.

13. A side door of a motorized vehicle, comprising:

a latch member;

a latch mechanism configured to cooperate with the latch member, the latch member being disposed at a frame of the side door;

an actuator configured to lock and unlock the latch mechanism and disposed at a distance from the latch mechanism;

a mechanical coupling configured to mechanically couple the actuator and the latch wherein the mechanical coupling comprises a coupling member having a different shear moduli in a transverse direction and in a longitudinal direction; and a disengagement apparatus configured to mechanically disengage the mechanical coupling at the coupling member in response to an external force, wherein the disengagement apparatus comprises a mounting portion being disposed between an outer door panel of the motorized vehicle and a handle module of a side door, the mounting portion and the handle module comprise a mutually corresponding lock.

14. The side door according to claim 13, wherein the coupling member comprises a sleeve and a first section and a second section comprise a blind hole configured to receive an end portion of the first rod portion or second rod portion and the intermediate section being reduced in diameter compared to the first section and the second section.

15. The side door according to claim 13, wherein the coupling member is an injection molded component.

16. A side door of a motorized vehicle, comprising:

a latch member;

a latch mechanism configured to cooperate with the latch member, the latch member being disposed at a frame of the side door;

an actuator configured to lock and unlock the latch mechanism and disposed at a distance from the latch mechanism;

a mechanical coupling configured to mechanically couple the actuator and the latch, wherein the mechanical coupling is a lock rod that interconnects the latch mechanism with a key cylinder disposed in the handle module of the side door; and a disengagement apparatus configured to mechanically disengage the mechanical coupling between the actuator and the latch mechanism in response to an external force, wherein the disengagement apparatus comprises a mounting portion being disposed between an outer door panel of the motorized vehicle and a handle module of a side door, the mounting portion and the handle module comprise a mutually corresponding lock.

* * * * *